United States Patent [19]

Boor

[11] Patent Number: 5,028,932

[45] Date of Patent: Jul. 2, 1991

[54] INVERTED DELTA HIGH EFFICIENCY LOOP ANTENNA FOR ALL HIGH FREQUENCIES

[76] Inventor: Ivan G. Boor, 178 Keystone Terr., Haines City, Fla. 33844

[21] Appl. No.: 512,403

[22] Filed: Apr. 23, 1990

[51] Int. Cl.[5] ..... H01Q 1/12; H01Q 7/02

[52] U.S. Cl. ..... 343/723; 343/741; 343/868; 343/877; 343/886

[58] Field of Search ..... 343/723, 741, 748, 866, 343/868, 877, 886

[56] References Cited

U.S. PATENT DOCUMENTS

| | | | |
|---|---|---|---|
| 806,966 | 12/1905 | De Forest | 343/748 |
| 919,115 | 4/1909 | Babcock | 343/866 |
| 1,438,290 | 12/1922 | Beakes | 343/723 |
| 2,169,377 | 8/1939 | Walter | 343/723 |
| 2,508,648 | 5/1950 | O'Brien et al. | 343/874 |
| 2,573,682 | 11/1951 | Barret | 343/723 |
| 2,702,345 | 2/1955 | Walter | 343/723 |
| 3,376,577 | 4/1968 | Kennedy | 343/886 |
| 3,400,402 | 9/1968 | Gallagher et al. | 343/723 |
| 3,530,474 | 9/1970 | Campbell | 343/749 |
| 3,950,756 | 4/1976 | Tisler | 343/868 |

*Primary Examiner*—Michael C. Wimer

*Attorney, Agent, or Firm*—Hoffman, Wasson & Gitler

[57] ABSTRACT

A flexible antenna which operates to control both the reactance as well as the resistance of the antenna. A motorized pulley system attached between two supports is utilized to control the effectrive length of the wire as well as the height of the antenna above ground. The antenna includes a flat base portion suspended between the supports and leg portions extending from the base to the apex of the triangle close to the ground. The total length of the antenna as well as the height of the base portion above the ground is dependent upon the particular frequency which is to be transmitted or received.

7 Claims, 4 Drawing Sheets

INVERTED DELTA HIGH EFFICIENCY LOOP ANTENNA FOR ALL HIGH FREQUENCIES

BACKGROUND OF THE INVENTION

Prior art antennas have been produced having electrical characteristics which are known to be 150 ohms resistive when the total length of wire is one-half wavelength in the vertical position. These antennas are themselves basically grounded, vertically polarized and exhibit an omnidirectional radiation pattern and are called folded monopole antennae.

Additional prior art antennas include those described with respect to U.S. Pat. Nos. 1,438,290 to Beakes; 2,169,377 issued to Walter; 2,508,648 issued to O'Brien; 2,573,682 issued to Barret; 2,702,345 issued to Walter; 3,376,577 issued to Kennedy; 3,400,402 issued to Gallagher and 3,530,474 issued to Campbell. For example, the patent to Campbell describes an antenna which utilizes loading in the form of capacitance, induction, or both, for shortening the physical antenna length or height relative to the electrical length. Two insulators are provided and, if they move upward, the length of various wires will increase, thus increasing the capacity to ground of the top loading conductors.

Walter '345 discusses an antenna having a vertically disposed portion and a horizontally disposed portion, wherein the length of the vertically disposed portion can be changed. As illustrated in Figure 14, a tower supports a pulley and a block carries a second pulley which receives a cable secured to an insulator. This cable can act as an antenna and has a vertically disposed portion and a horizontally disposed portion between various pulleys. Changes in the length of the vertically disposed portion of the cable can be effected by lengthening or shortening a rope attached to a different pulley. Impedance matching will be effected by changing the length of the vertically disposed portion of the cable.

The additional patents mentioned hereinabove describe various antennas having a variable length, utilize a pulley system or are of general interest.

However, none of these patents describe an antenna whose resistance is reduced to 50 ohms nominal by creating a triangularly shaped antenna having a top flat portion, and further the total effective length is one half wavelength. Furthermore, no reference is known wherein the proportion of wire length to the height of the base portion of the triangular antenna is controlled automatically by changing the total length of the antenna wire as well as the distance between the flat portion of the antenna wire and the ground.

SUMMARY OF THE INVENTION

The deficiencies of the prior art are overcome by the present invention which is directed to a shortwave communications system able to radiate efficiently all frequencies since it is mechanically tuned to resonance at the desired resistance of any desired frequency.

This result is accomplished by spreading a length of flexible antenna wire across two vertical supports to form the base of a triangle whose apex is approximately at ground level. The length of antenna wire would extend from each end of the base of the triangular antenna to the apex of the triangle at ground level. Therefore, by utilizing a system for changing the effective physical length of the antenna as well as the height of the triangle, different frequencies can be transmitted or received.

In this context, it is noted that the proportion of wire length of the antenna controls the reactance of the system and the height of the triangular antenna controls the resistance of the system. In addition, it should be noted that the entire length of the antenna wire for each and every frequency of interest would be one-half wavelength except in the case where the total length could be any multiple of one-half wavelength.

BRIEF OF DESCRIPTION OF DRAWINGS

These other objects and the advantages of the present invention will become apparent from the detailed description and drawings in which.

DETAILED DESCRIPTION OF THE PRESENT INVENTION

The present invention as illustrated with respect to FIGS. 1–4 describes an antenna designed to improve the quality and efficiency of all shortwave and other communication frequencies at a minimal of cost of construction materials and an economy of space, particularly where a multiplicity of frequency transmissions are used. The antenna of the present invention will radiate efficiently on all frequencies since the antenna is mechanically tuned to resonance at the desired value of resistance on any frequency. Additionally, tuning the antenna to a desired frequency permits automatic matching of the antenna to the transmission line and transmitter output, thereby reversing the common practice of using a transmitter matching network to tune out antenna reactance but allowing high standing wave ratios on the transmission line and antenna, thereby reducing the efficiency of the system.

Figure 1:
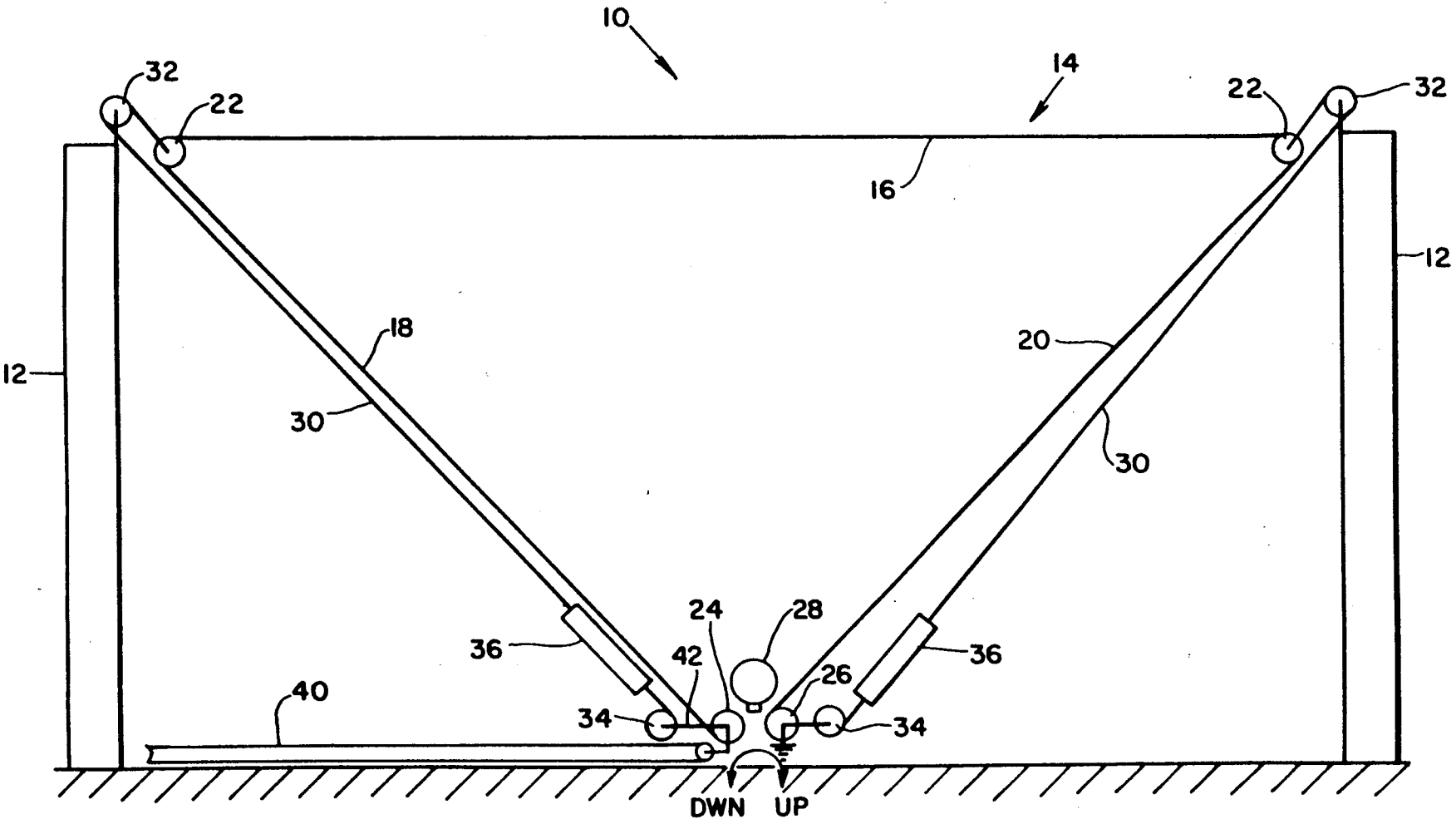
FIG. 1 is a sideview of one embodiment of the present invention for receiving and transmitting at the lowest frequency.
Figure 2:
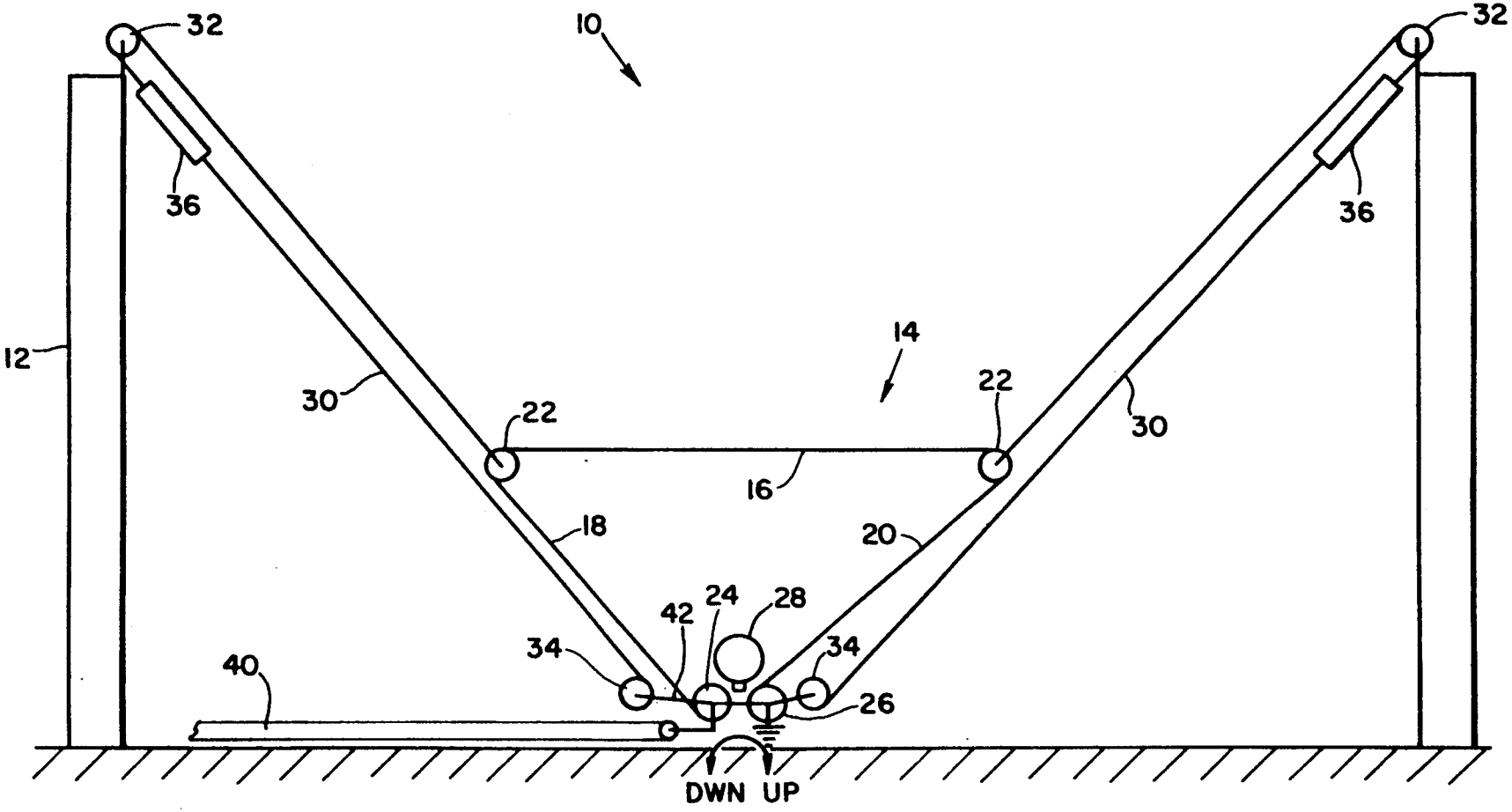
FIG. 2 is a sideview of the first embodiment of the present invention set to receive at the highest frequencies.

FIGS. 1 and 2 illustrate a first embodiment of the present invention designed to transmit and receive the lowest frequency possible and the highest frequency possible respectively, based upon the parameters of the present invention.

As shown in FIG. 1, the antenna system 10 of the present invention includes a flexible line antenna 14 constructed from any suitable material supported by two support devices 12 such as poles, towers or other points of attachment for the antenna. It should be noted that these support devices can be movable or immovable. The antenna itself consists of a flat base portion 16 as well as two legs 18 and 20. The legs 18 and 20 extend from the base portion 16 and form an apex close to the ground. Two pulleys 22 are provided at the intersection of the base 16 with each of the legs 18 and 20 with the antenna wire looped therearound. The antenna wire leg 18 would then extend from the pulley 22 to a motor driven drum 24. Similarly, the leg of the antenna wire 20 would extend from the pulley 22 to a motor driven drum 26. The drum 24 is insulated and leg 18 is connected to a transmission line 40 which is in turn connected to a transceiver (not shown). Additionally, it is noted, that the motor driven drum 26 is grounded. Both of these drums 24, 26 are driven by a reversible gear-head motor 28 controlled to drive both drums simultaneously in the same direction. As shown with respect to FIGS. 1 and 2, rotation of the drums 24, 26 in a counter-clockwise motion would lower the antenna wire and rotation of the drums 24, 26 in a clockwise direction would raise the height of the antenna.

The raising and lowering of the antenna is accomplished by running nylon or other type of an insulating line 30 around suspension pulleys 32, each of which is supported by its respective support tower 12. Line 30 is supported by each of the pulleys 22. Each end of line 30 is then terminated at respective drums 34 provided on a common drive shaft 42. Take-up springs 36 are provided for each leg of the support pulley line for the purpose of maintaining a constant tension on the antenna wire while it is raised or lowered.

Figure 3:
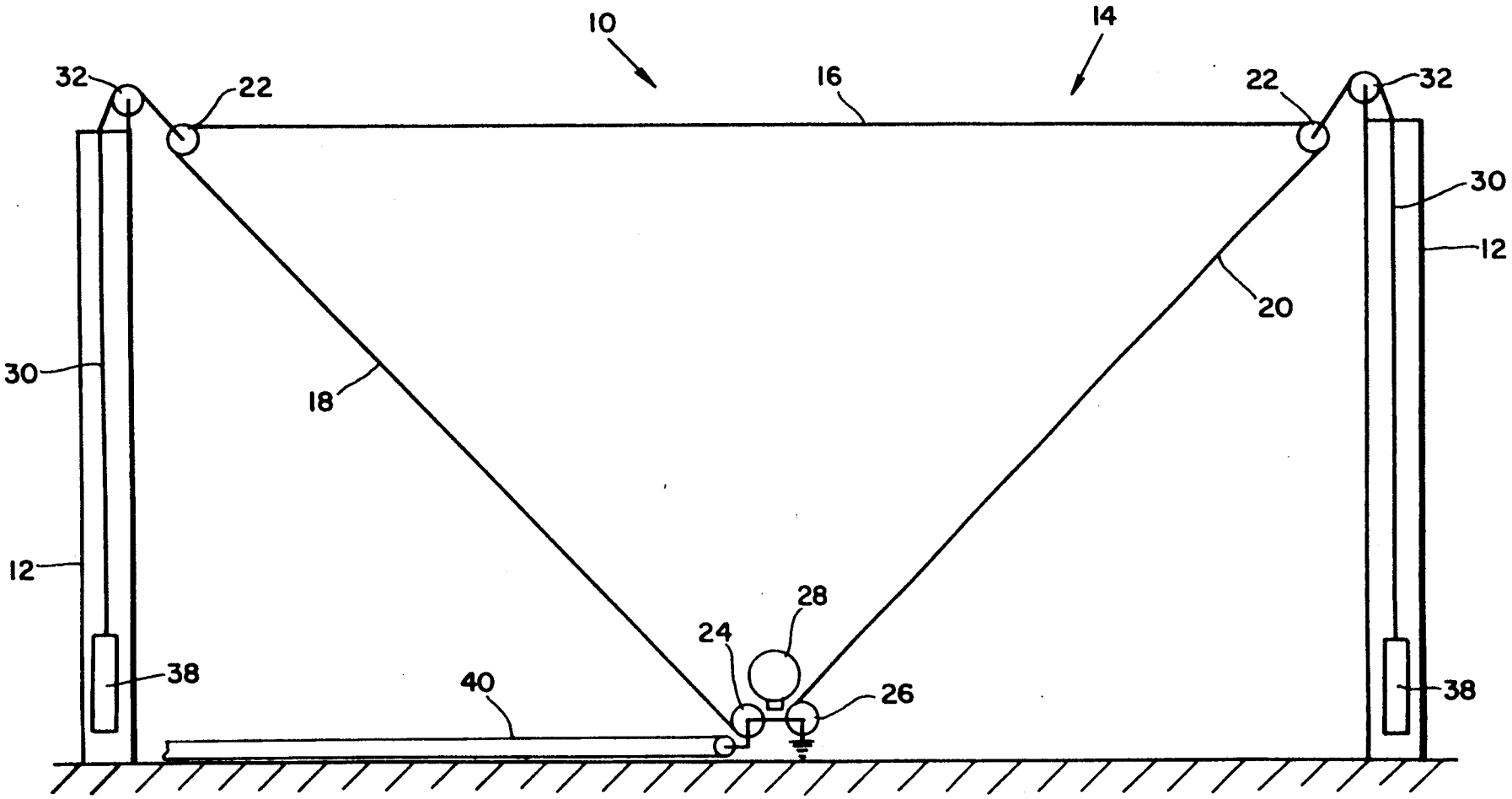
FIG. 3 is a second embodiment of the present invention set to receive at the lowest frequencies.
Figure 4:
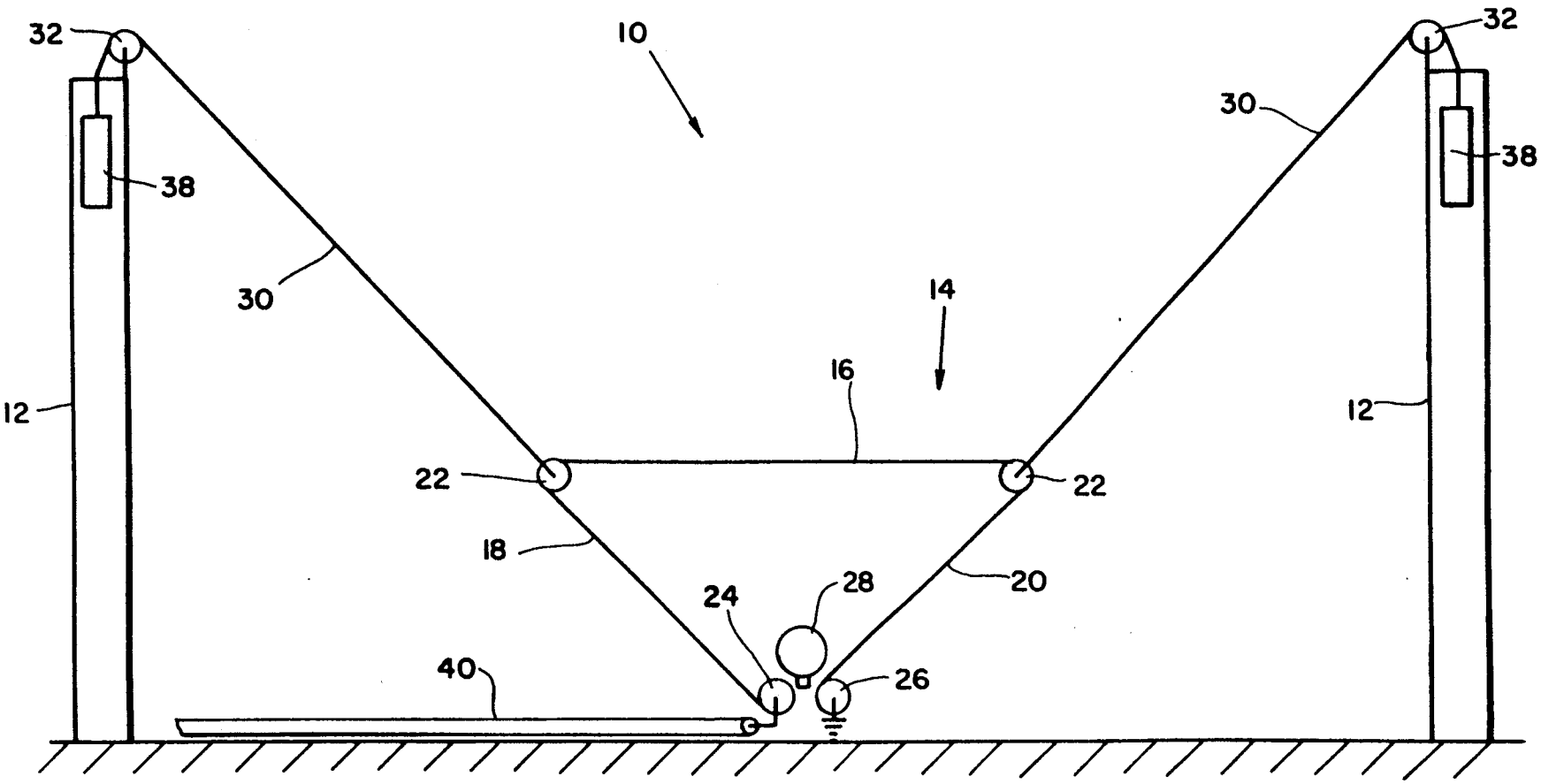
FIG. 4 is a sideview of the second embodiment of the present invention set to receive at the highest frequency level.

FIGS. 3 and 4 illustrate a second embodiment of the present invention with FIG. 3 illustrating an antenna adapted to receive the lowest frequency and FIG. 4 adapted to receive the highest frequency. In this embodiment, support lines 30 would run from pulleys 22 through suspension pulley 32 and would be terminated by respective counterweights 38 provided within the support device 12. It is noted that this embodiment does not utilize the springs 36.

It has been determined that this antenna would have optimal efficiency utilizing a base of 76 degrees, two legs of 52 degrees each and a height of approximately 40 degrees as well as a 50 ohm resistance at resonance, depending upon the quality of the ground.

While it is also noted that FIGS. 2 and 4 are illustrated to transmit and receive at the highest frequency, i.e., approximately 30 MHz, it is assumed that this antenna would then be operating in its basic mode. However, the antenna may be operated on any harmonic of the basic 3 to 30 Mhz to improve radiation efficiency.

Additionally, although it is desirable for the antenna to present a resistance of 50 ohms at resonance the basic mode of operation, this is not a requirement for normal operations. For example, should the supporting structure be higher than necessary and measurement indicates a resistance of 100 ohms, this value can be reduced to 50 ohms by using a wide band transformer of the correct ratio inserted between the antenna and the transmission line.

A similar condition exists when operating on harmonic frequencies which automatically change the effective height of the antenna and raise the resistance accordingly. These conditions can be corrected by using the proper ratio transformer.

Prior to operation, the antenna can be calibrated by recording points of resonance in several modes such as basic one half wave, two half waves, three half waves, etc., against an indicator showing the position of the antenna at all times. During operation, a frequency and mode is chosen and checked against the chart for the specific antenna footage required. Low powers are then used to adjust the standing wave ratio followed by measurement of the output power.

While the present invention has been described in connection with illustrative embodiments, obvious modifications thereof are possible without departing from the spirit of the invention. For example, while it has been indicated that the present invention can operate generally between 3 and 30 MHz, this frequency band should not be so limited. The present antenna could be applicable to higher as well as lower ratio frequency bands should the need arise. Furthermore, a VHF antenna adjustable from 30 to 300 MHz may be useful in some applications.

It should also be noted that this antenna has other attributes which are not immediately apparent. Because of its configuration and grounding of one end of the half wave antenna, the currents in both quarter wave sections must be in phase and the point of highest impedance is in the center of the triangle's base which is directly above the apex. This is also the highest voltage point of the antenna and the most isolated from ground permitting reduced insulation requirements at points 22 and increasing its ability to radiate very high power. This feature, together with its ability to resonate on any frequency in the H.F. band without external reactances, would make it very useful in services having these requirements.

What is claimed is:

1. An antenna system, comprising:

first and second vertical supports, each vertical support extending from the ground;

a flexible antenna wire configured in the form of a triangle having a base and two legs, the base extending between said first and second vertical supports and parallel to the ground, each of said legs extending from one end of said base and converging with each other to form an apex close to the ground, the distance from said apex to the ground being less than the distance between said base and the ground; and a first means for simultaneously changing the effective length of said flexible antenna and the height of said base of said triangle with respect to the ground, a portion of said means supported by each of said first and second vertical supports and connected to each end of said base of said triangle, said flexible antenna wire maintaining its triangular configuration when said first means changes the effective length of said flexible antenna wire and the height of said base of said triangle with respect to the ground, the antenna system capable of operation at all heights of said base of said triangle with respect to the ground.

2. The antenna system in accordance with claim 1, wherein said first means comprises:

a first pulley supported by said first vertical support;

a second pulley supported by said second vertical support;

a third pulley provided at the convergence of said base of said triangle and one of said legs and connected to said first pulley by one end of a first cable, said antenna wire extending around said third pulley;

a fourth pulley provided at the convergence of said base of said triangle and the other of said legs and connected to said second pulley by one end of a second cable, said antenna wire extending around said fourth pulley;

a first driven drum provided near the apex of the triangle and connected to one of the legs of said triangle;

a second driven drum provided near the apex of the triangle and connected to the other leg of said triangle; and a reversible motor connected to said first and second driven drums.

3. The antenna system in accordance with claim 2 further including first and second counterweights and wherein each of said first and second cables extend around said first and second pulleys respectively and terminate with said first and second couterweights respectively.

4. The antenna system in accordance with claim 3, wherein each of said counterweights extend within said first and second vertical supports.

5. The antenna system in accordance with claim 2, further including first and second drums provided near the apex of said triangle and wherein said first cable extends around said first pulley and is connected to said first drum, and said second cable extends around said second pulley and is connected to said second drum.

6. The antenna system in accordance with claim 5, wherein said first and second drums are provided on a common drive shaft.

7. The antenna system in accordance with claim 1, wherein the effective length of said flexible antenna wire is one-half wavelength.

* * * * *